US005085981A

United States Patent [19]

Himmelmann et al.

[11] Patent Number: 5,085,981

[45] Date of Patent: Feb. 4, 1992

[54] PHOTOGRAPHIC SILVER HALIDE ELEMENT WITH PROTECTIVE LAYER

[75] Inventors: Wolfgang Himmelmann; Prem Lalvani, both of Leverkusen; Hans-Theo Buschmann, Cologne; Günter Helling, Odenthal, all of Fed. Rep. of Germany

[73] Assignee: Agfa Gevaert Aktiengesellschaft, Leverkusen, Fed. Rep. of Germany

[21] Appl. No.: 511,250

[22] Filed: Apr. 19, 1990

[30] Foreign Application Priority Data

May 3, 1989 [DE] Fed. Rep. of Germany ..... 3914567

[51] Int. Cl.[5] ..... B03C 1/82

[52] U.S. Cl. ..... 430/536; 430/523; 430/950; 430/961

[58] Field of Search ..... 430/950, 951, 523, 536, 430/273

[56] References Cited

U.S. PATENT DOCUMENTS

| | | | |
|---|---|---|---|
| 3,547,644 | 12/1970 | Moede et al. | 430/950 |
| 3,591,379 | 7/1971 | Plakunov | 430/950 |
| 3,856,527 | 12/1974 | Hamb et al. | 430/950 |
| 4,168,979 | 9/1979 | Okishi et al. | 430/950 |
| 4,232,117 | 11/1980 | Naoi et al. | 430/950 |
| 4,409,322 | 10/1983 | Ezaki et al. | 430/950 |
| 4,499,179 | 2/1985 | Ota et al. | 430/950 |
| 4,552,835 | 11/1985 | Nakamura et al. | 430/950 |
| 4,610,924 | 9/1986 | Tamagawa et al. | 430/950 |
| 4,678,742 | 7/1987 | Tamagawa et al. | 430/950 |
| 4,711,838 | 12/1987 | Grzeskowiak et al. | 430/950 |

*Primary Examiner*—Jack P. Brammer
*Attorney, Agent, or Firm*—Connolly and Hutz

[57] ABSTRACT

A photographic recording material comprising a support, at least one photosensitive silver halide emulsion layer, a protective layer on that side of the at least one silver halide emulsion layer remote from the support and, optionally a backing layer, the protective layer and/or the backing layer containing in combination (a) a polymeric compound (I) containing at least 0.2 mol-% recurring units corresponding to the following formula

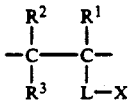

in which $R^1$, $R^2$ and $R^3$ may be the same of different and represent hydrogen, alkyl or halogen, L is a chemical bond or a standard binding link and X is a reactive group, and (b) a finely divided crystalline $SiO_2$ dispersion having an average particle diameter (number average) of from 0.7 to 1.2 μm and containing less than 0.2% by volume particles larger than 4 μm in size, are distinguished by good retouchability in combination with good mechanical properties.

6 Claims, No Drawings

PHOTOGRAPHIC SILVER HALIDE ELEMENT WITH PROTECTIVE LAYER

This invention relates to a photographic recording material which shows good retouchability in combination with good mechanical properties for example high scratch resistance of the contact partner, and which contains a combination of certain quartz particles with polymers containing reactive groups in the protective layer.

The hydrophilic colloids, for example gelatine, typically present in the outer layers of photographic recording materials, particularly silver halide recording materials, lead to an increase in the tackiness of the recording materials at high atmospheric humidity levels and at relatively high temperatures, so that recording materials of this type, for example after packing in a stack, stick easily to one another. This adhesion between various parts of the recording material and between the recording material and other materials which come into contact with it leads to numerous difficulties.

To overcome these difficulties, it is known that the outer layers of recording materials can be given a matt finish, so that their tackiness is reduced, by the incorporation of finely powered inorganic compounds, such as silicon dioxide, magnesium oxide, titanium dioxide or calcium carbonate, or organic compounds, such as polymethyl methacrylate or cellulose acetate propionate.

DE-A 2 758 767 describes a photographic photosensitive material comprising an outer non-photosensitive gelatine layer containing colloidal silica particles from 7 to 120 nm in size and a polymer latex of which the particles are from 30 to 80 nm in size. This gelatine layer is intended to provide the photographic material with increased tear resistance and dimensional stability.

However, the disadvantage of a photographic material finished in this way is that the additives reduce the transparency of the layers and sensitometrically unfavorable contact stains cannot be avoided when the materials are rolled up, particularly at relatively high atmospheric humidity levels (for example more than 85% relative humidity) and at temperatures around 35° to 40° C.

In addition, these materials cannot be retouched after processing.

DE-OS 1 547 667 describes a photographic material which has improved retouching properties and increased resistance to abrasion and fingerprints and which contains both soft matting agents containing relatively large particles (organic polymers, such as ethyl cellulose and polymeric esters of acrylic and methacrylic acid) and also hard matting agents containing small particles (silicon dioxide, calcium carbonate, magnesium oxide).

These materials shown inadequate wet scratching resistance.

Accordingly, the problem addressed by the invention was to provide a material which, in addition to good retouchability, shows good mechanical properties, particularly wet scratching resistance, parallel break resistance and dry scratch resistance without the sensitometric properties, such as sensitivity, fog, sharpness, granularity, being adversely affected.

According to the invention, this problem is solved by the introduction of both a finely divided $SiO_2$ dispersion having a certain mean particle size and a narrow particle size distribution and also a polymer containing reactive groups into the uppermost protective layer and/or the backing layer.

Accordingly, the present invention relates to a photographic recording material comprising a support, at least one photosensitive silver halide emulsion layer, a protective layer on that side of the at least one silver halide emulsion layer remote from the support and, optionally a backing layer, the protective layer and/or the backing layer containing in combination (a) a polymeric compounds (I) containing at least 0.2 mol-% recurring units corresponding to the following formula

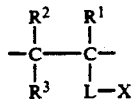

in which $R^1$, $R^2$ and $R^3$ may be the same or different and represent hydrogen, alkyl or halogen, L is a chemical bond or a standard binding link and X is a reactive group, and b) a finely divided crystalline $SiO_2$ dispersion having an average particle diameter (number average) of from 0.7 to 1.2 μm and containing less than 0.2% by volume particles larger than 4 μm in size and less than 5% by volume particles smaller than 0.5 μm in size.

The combination of the $SiO_2$ dispersion and polymer (I) containing reactive groups is preferably used in the uppermost protective layer, color negative films, color reversal films and black-and-white films in the form of flat films, roll films or microfilms representing preferred materials.

The $SiO_2$ dispersion is used in particular in a quantity of from 50 to 500 mg and preferably in a quantity of from 150 to 250 mg/m$^2$ while polymer (I) containing the reactive groups is used in a quantity of from 50 to 250 mg/m$^2$.

In general, the protective or backing layer also contains a binder. The ratio by weight of binder to polymer I to $SiO_2$ is preferably 1:0.2 to 5.0:0.3 to 2.0 and more especially of the order of 1:1.1:0.5. The thickness of the protective or backing layer is preferably from 0.2 to 5 μm. Preferred binders are gelatine and gelatine derivatives.

In the context of the invention, a reactive group is understood to be a group which is capable of reacting with substances containing —$NH_2$—, —COOH— or —OH— groups in an addition or condensation reaction in such a way that chemical linkage to the substance in question can occur. The groups in question are in particular groups which are capable of reacting with gelatine in the described manner.

The following are preferred reactive groups X:

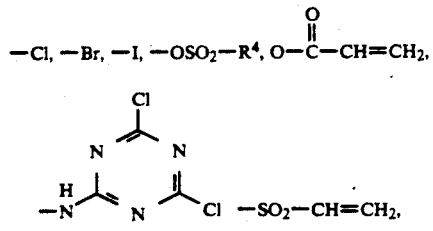

-continued

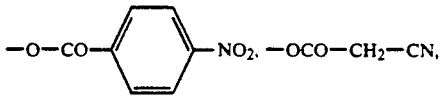

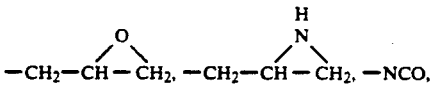

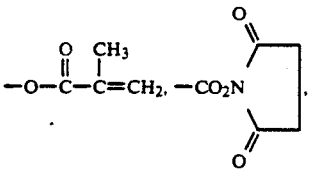

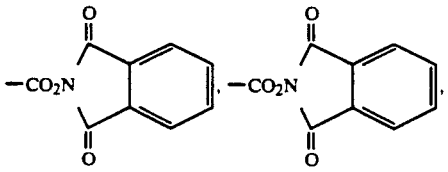

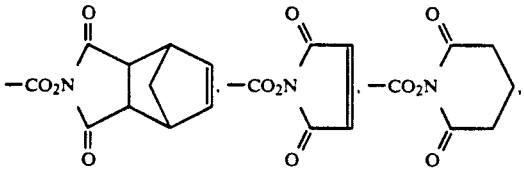

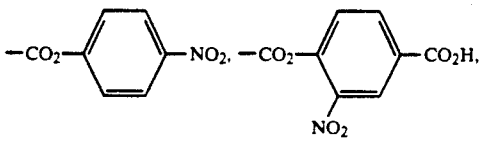

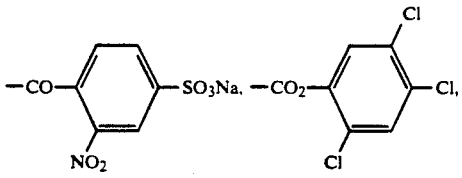

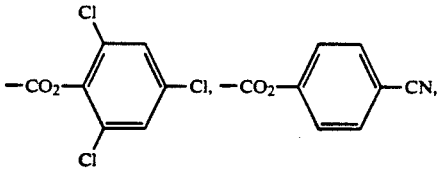

$-CO_2CH_2CN$, $-CO_2CH_2CO_2C_2H_5$, $-CO_2CH_2CONH_2$,

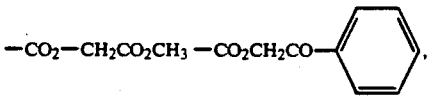

$-CO_2CH_2CO_2CH=CH_2$, $-CO_2N=CHCH_3$, $-CO_2N=C(CH_3)_2$, $-CO_2C(CH_3)=CHCOOCH_3$,

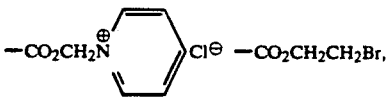

-continued

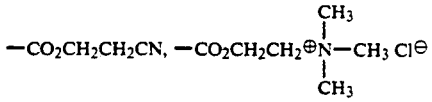

$R^4$=alkyl, aryl, aralkyl.

In one preferred embodiment of the invention, the recurring units corresponding to formula I have the following structure:

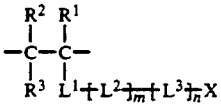

in which $R^1$, $R^2$, $R^3$ and X are as defined above and $L^1$ is a —CONH—, —COO— or phenylene group, $L^2$ is an alkylene group containing 1 to 20 C atoms or an arylene group containing 6 to 20 C atoms, $L^3$ is a —COO—, —OCO—, —CONH—, —NH—CO—O—, —NHCO—, $-SO_2NH-$, $-NHSO_2-$, $-SO_2-$group or —O—, m=0, 1 or 2 and n=0, 1 or 2.

$R_1$ is preferably hydrogen or methyl and $R_2$ and $R_3$ are preferably hydrogen.

In another preferred embodiment, X represents halogen, epoxy, imido, —NCO—, $-CH=CH_2-$, $-C(CH_3-CH_2-$ or —CN. The following are particularly preferred examples of the recurring units:

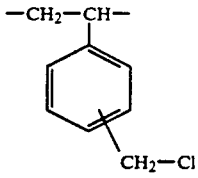

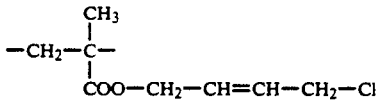

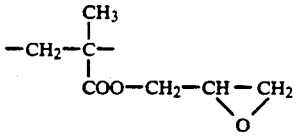

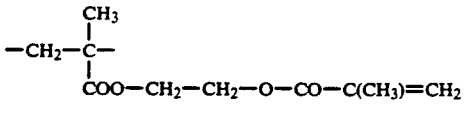

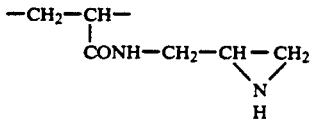

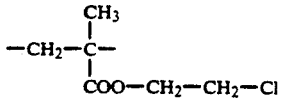

-continued

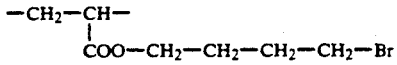

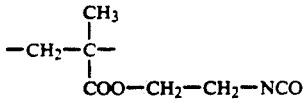

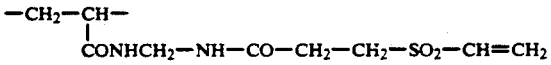

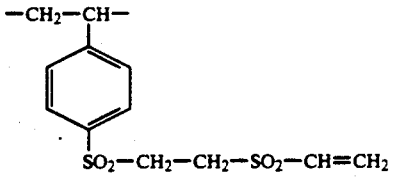

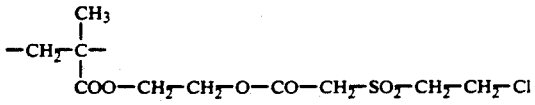

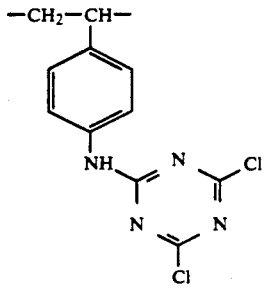

-continued

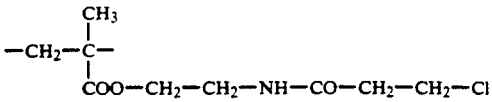

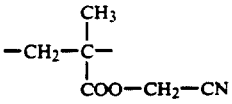

0 to 99.8 mol-% of the constituents of polymer I are monomers without a reactive group which are derived from optionally substituted acrylates, methacrylates, aromatic vinyl compounds and acrylonitriles. In another preferred embodiment, the polymers I have a glass transition temperature of at least 50° C. The glass transition temperature may be adjusted as required through the choice of suitable monomers. The average molecular weights Mn of the polymers are above 10,000, preferably above 100,000 and below 2,000,000, molecular weights of up to $10^{12}$ being obtained for crosslinked polymers used as latices. 0.5 to 25 mol-% of polymer I preferably consists of monomers containing reactive groups.

Examples of monomers with no reactive groups can be found in Polymer Handbook, Section III "The Glass Transition Temperatures of Polymers". Some examples are ethyl methacrylate, methyl methacrylate, isobornyl methacrylate, phenyl methacrylate, cyclohexyl chloroacrylate, methyl chloroacrylate, 4-tert.-butyl styrene, 2,5-dimethyl styrene, styrene, vinyl toluene, acrylonitrile, methacrylonitrile.

The following are examples of suitable polymers (the monomer component being shown in mol-%):

A

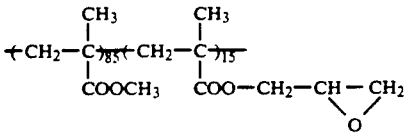

Mn = 140,000

B

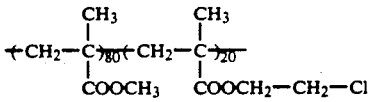

Mn = 320,000

C

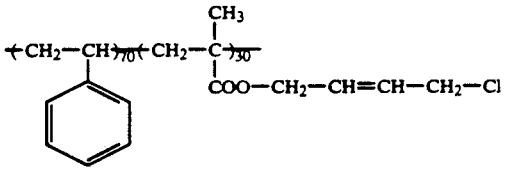

Mn = 530,000

D

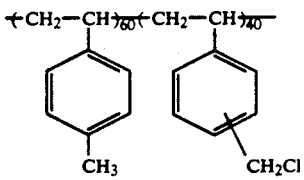

Mn = 85,000

-continued

E

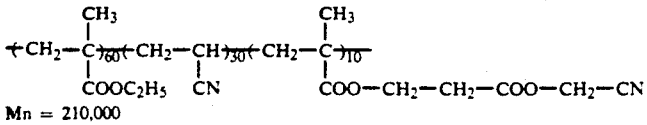

Mn = 210,000

F

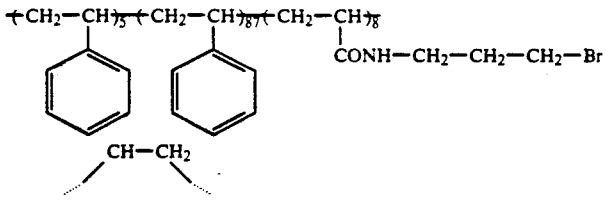

Mn = $10^9$

G

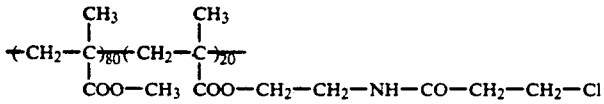

Mn = 1,100,000

H

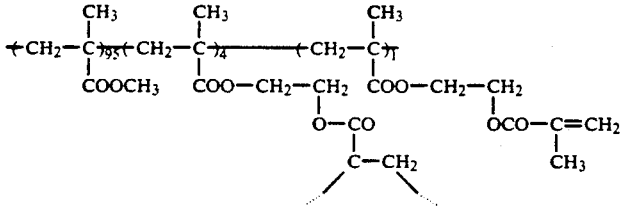

Mn = $5 \cdot 10^8$

I

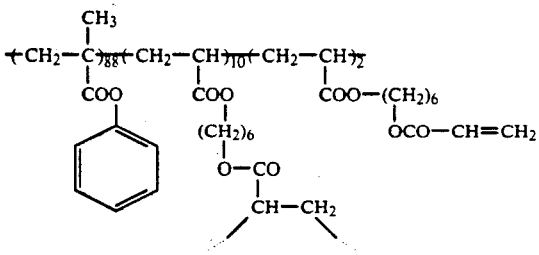

Mn = $6 \cdot 10^9$

K

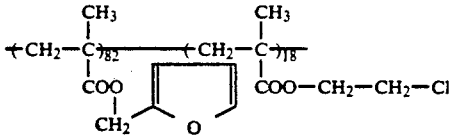

Mn = 880,000

The polymers are preferably used in the form of polymer latices. In this case, they have an average particle diameter of from 0.02 μ to 0.8 μ and preferably 0.04 μ to 0.3 μ.

In one preferred embodiment, the layers of the photographic recording material according to the invention are hardened with an instant hardener. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

The instant hardeners are used in particular in a quantity of from 2 to 10% by weight and preferably in a quantity of from 4 to 7% by weight, based on the total binder content.

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

(a)

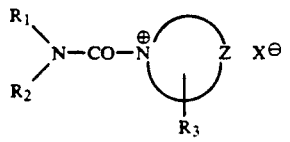

in which $R_1$ is alkyl, aryl or aralkyl, $R_2$ has the same meaning as $R_1$ or represents alkylene, arylene, aralkylene or alkaralkylene, the second bond being attached to a group corresponding to formula

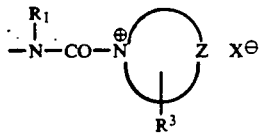

or $R_1$ and $R_2$ together represent the atoms required to complete an optionally substituted heterocyclic ring, for example a piperidine, piperazine or morpholine ring, the ring optionally being substituted, for example, by $C_{1-3}$ alkyl or halogen, $R_3$ is hydrogen, alkyl, aryl, alkoxy, $—NR_4—COR_5—$, $—(CH_2)_M—NR_8R_9$, $—(CH_2)_n—CONR_{13}R_{14}—$ or $$—(CH_2)_p—\underset{\underset{R_{15}}{|}}{CH}—Y—R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ being hydrogen, $C_{1-4}$ alkyl or $NR_6R_7$, $R_8$ being $—COR_{10}$, $R_{10}$ being $NR_{11}R_{12}$, $R_{11}$ being $C_{1-4}$ alkyl or aryl, particularly phenyl, $R_{12}$ being hydrogen, $C_{1-4}$ alkyl or aryl, particularly phenyl, $R_{13}$ being hydrogen, $C_{1-4}$ alkyl or aryl, particularly phenyl, $R_{16}$ being hydrogen, $C_{1-4}$ alkyl, $COR_{18}$ or $CONHR_{19}$, m being a number of 1 to 3, n being a number of 0 to 3, p being a number of 2 to 3 and Y being O or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

(b)

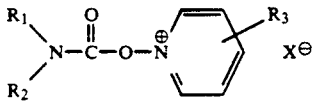

in which $R_1$, $R_2$, $R_3$ and $X^{\ominus}$ are as defined for formula (a).

The following are examples of such hardeners (H—):

H-1

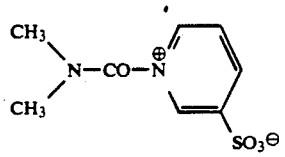

H-2

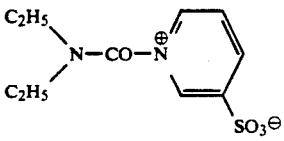

H-3

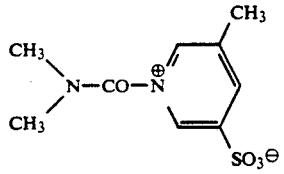

H-4

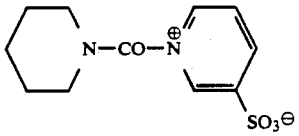

H-5

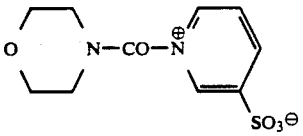

H-6

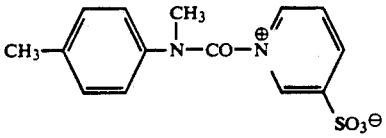

H-7

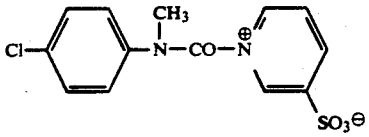

H-8

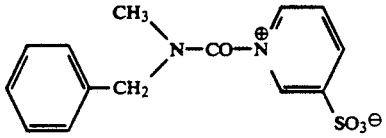

H-9

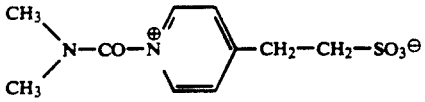

-continued

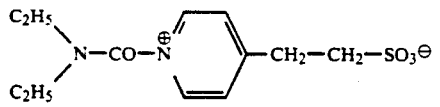
H-10

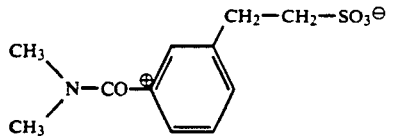
H-11

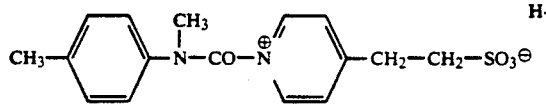
H-12

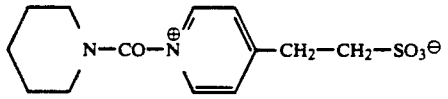
H-13

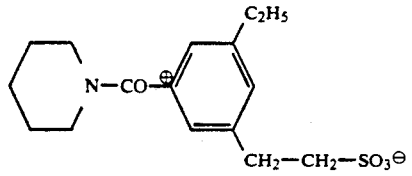
H-14

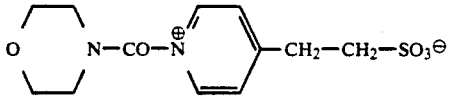
H-15

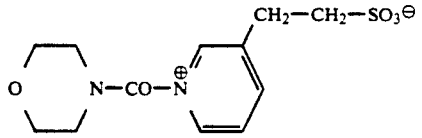
H-16

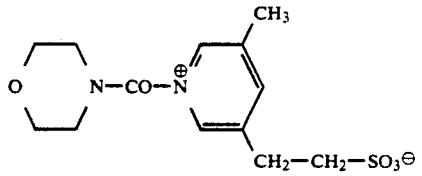
H-17

The binder to be hardened which is used in the layers subjected to the hardening process according to the invention is a protein-like binder containing free amino groups and free carboxyl groups. Gelatine is a preferred example. In photographic recording materials, gelatine is mainly used as binder for the photosensitive substances, the dye-producing compounds and, optionally, other additives. In many cases, recording materials of the type in question comprise a number of different layers. Hardening with hardeners that activate carboxyl groups is generally carried out by applying an excess of the hardener as the last layer to the layers to be hardened, other substances, such as UV absorbers, antistatic agents, matting agents and polymeric organic particles, optionally being added to the hardening coating solution.

In addition to the crystalline $SiO_2$ according to the invention, inorganic and organic matting agents are used as matting agents (spacers). In one preferred embodiment, the outermost protective layer or the backing layer contains alkali-soluble spacers.

Alkali-soluble spacers are preferably spacers which dissolve in the usual alkaline processing baths. In particular, they dissolve at pH values above pH 8.0. The spacers preferably have an average size of 0.5 to 6 μm and more especially 1 to 3 μm.

The usual alkali-soluble spacers may be used, particular, preference being attributed to particles of a graft polymer of methacrylic acid and methyl methacrylate based on an α-olefin or styrene/maleic semiamide or maleic acid copolymer having a particle size of from 0 5 to 8 μm and a particle size distribution of ±1 μm, as known from DE-A-3 331 542.

Other suitable alkali-soluble spacers are cellulose derivatives which are substituted by alkyl hydroxyalkyl and with partial esterification of dicarboxylic acids. Other alkali-soluble spacers are described in U.S. Pat. Nos. 2,992,101, 4,094,848 and 4,142,894 and in GB-PS 1,055,713.

The spacers are preferably used in a quantity of from 30 to 500 mg/m$^2$ and preferably in a quantity of from 50 to 200 mg/m$^2$ per layer.

These compounds are preferably copolymers and may be prepared by emulsion polymerization or by polymerization of a monomer in an organic solvent and subsequent dispersion of the solution in latex form in an aqueous solution of gelatine. The polymer containing reactive groups may also be prepared by emulsion polymerization processes of the core-shell type (cf. for example U.S. Pat. No. 4,714,671). In this case, the particle shell and the particle core may differ in composition.

The radical polymerization of an ethylenically unsaturated monomer is initiated by the addition of free radicals formed by thermal decomposition of a chemical initiator, by the action of a reducing agent on an oxidizing compound (redox initiator) or by physical effects, such as irradiation with ultraviolet light or other high-energy radiation, high frequency. Examples of chemical initiators comprise persulfates (for example ammonium persulfate or potassium persulfate), hydrogen peroxide, peroxides (for example benzoyl peroxide or tert.-butyl peroctoate) and azonitrile compounds (for example 4,4'-azo-bis-4-cyanovaleric acid and azo-bis-isobutyronitrile). Examples of conventional redox initiators are hydrogen/iron(II) salt, potassium persulfate, sodium metabisulfite and cerium(IV) salt/alcohol. Examples of the initiators and their functions are described by F. A. Bovey in Emulsion Polymerization, Intersicence Publishers Inc., New York, 1955, pages 59 to 93. The emulsifier which may be used in the emulsion polymerization is a surface-active compound. Preferred examples are soap, sulfonates, sulfates, cationic compounds, amphoteric compounds and protective colloids of high molecular weight. Special examples of emulsifiers and their functions are described in Belgische Chemische Industrie, Vol. 28, pages 16 to 20, 1963.

PREPARATION EXAMPLE (Polymer B)

A solution of 4 g alkyl diphenyl ether disulfonate and 500 g water is heated under nitrogen to 70° C. A mixture of 150 g methyl methacrylate and 40 g chloroethyl methacrylate, a solution of 1 g potassium peroxodisulfate in 50 g water and a solution of 0.5 g sodium metabisulfite in 50 ml water are then simultaneously introduced over a period of 90 minutes. After stirring for 2 hours, the pH is adjusted to 7 and some of the water is distilled off so that a solids content of 20% by weight is obtained.

The $SiO_2$ dispersion according to the invention is prepared in particular by wet grinding and is further processed as quickly as possible in the form of an aqueous dispersion because the particles are in danger of agglomerating in the event of drying or prolonged storage. In one advantageous embodiment of the invention, this danger is eliminated by charging the $SiO_2$ crystals at their surface with a water-soluble polymer. Suitable water-soluble polymers are polyacrylic acids, polyvinyl alcohols, polyvinyl pyrrolidone, polyacrylamides, copolymers of these compounds, such as copolymers and graft polymers, polymer sulfonic acid. Polymeric, water-soluble natural materials, such as gelatine, gelatine derivatives, carboxymethyl cellulose, cellulose sulfate, are also suitable.

The water-soluble polymers are used in particular in a quantity of from 0.1 to 50% by weight, based on crystalline $SiO_2$.

Preparation of the stock dipsersion of quartz particles

Quantities of 0.1 to 1% by weight of the anticoagulating additive are added to the freshly prepared aqueous quartz particle dispersion containing 30 to 50% by weight quartz particles. After stirring for 5 minutes, the dispersion is left standing at room temperature for 2 to 8 weeks sedimentation).

After 2 weeks and 2 months, redispersibility is tested with a laboratory stirrer rotating at 300 r.p.m. after 10 mins.

The dispersion must be completely redispersed after that time.

In one preferred embodiment, a polysiloxane dispersion, for example a dimethyl polysiloxane dispersion is added to the casting solution for the protective and/or backing layer according to the invention, more especially in a quantity of from 5 to 60 mg/m$^2$. The mechanical properties can be further improved in this way.

EXAMPLES

Quartz particle dispersion containing an anticoagulating additive:

QD 1) sodium polystyrene sulfonate

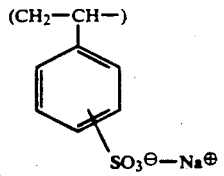

molecular weight Mn 20,000

QD 2) copolymer of acrylamide and acrylamido-2-methyl propane sulfonic acid

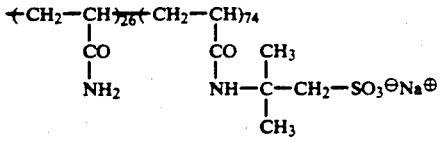

molecular weight Mn: 500,000

QD 3) block copolymer of 10 parts polyvinyl alcohol and 2 parts acrylic acid (as Na salt)

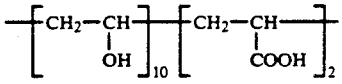

Mn: 100,000

QD 4) copolymer of vinyl pyrrolidone and styrene sulfonic acid 84: 16% by weight as sodium salt

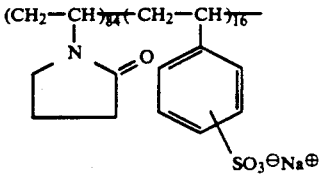

Mn: 20,000

QD 5) sodium polyacrylate

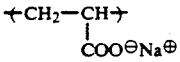

Mn: 80,000

QD 6) polyvinyl pyrrolidione K 90

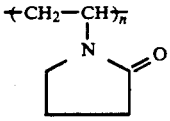

Mn: 50,000

QD 7) polyvinyl alcohol

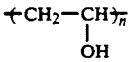

Mn: 40,000

QD 8) gelatine

QD 9) phthaloyl gelatine containing 5% by weight phthaloyl groups

QD 10) carboxymethyl sulfoethyl cellulose 2% by weight carboxy groups; 4% by weight sulfoethyl groups; Mn: 20,000

QD 11) sulfoethyl cellulose 4.5% by weight sulfoethyl groups; Mn: 40,000

QD 12) cellulose sulfate 2% by weight sulfate groups; Mn: 40,000

QD 13) polydextran Mn: 100,000

The -photographic, particularly color photographic, recording materials according to the invention are preferably multilayer materials comprising several silver halide emulsion layers or emulsion layer units of different spectral sensitivity. In the context of the invention, emulsion layer units are understood to be laminates of 2 or more silver halide emulsion layers of the same spectral sensitivity, the material typically containing at least one blue-sensitive silver halide emulsion layer, at least one green-sensitive silver halide emulsion layer and at least one red-sensitive silver halide emulsion layer. However, layers of the same spectral sensitivity need not necessarily be arranged adjacent one another, but instead may even be separated by other layers, particularly by layers of different spectral sensitivity. The binder in these layers is generally a protein-like binder containing free carboxyl groups and free amino groups, preferably gelatine. In addition to the protein-like binder, however, the layer binder may contain up to 50% by weight non-protein-like binders, such as polyvinyl alcohol, N-vinyl pyrrolidone, polyacrylic acid and derivatives thereof, particularly copolymers or cellulose derivatives.

At least one dye-producing compound, generally a color coupler, which is capable of reacting with color developer oxidation products to form a non-diffusing dye is associated with the photosensitive silver halide emulsion layers or emulsion layer units. The color couplers are accommodated in non-diffusing form in the photosensitive layer itself or in close proximity thereto. The color couplers associated with the two or more partial layers of an emulsion layer unit need not necessarily be identical. They are merely required during color development to produce the same color, normally a color which is complementary to the color of the light to which the photosensitive silver halide emulsion layers are sensitive.

Accordingly, at least one non-diffusing color coupler for producing the cyan component dye image, generally a coupler of the phenol or α-naphthol type, is associated with the red-sensitive silver halide emulsion layers. Cyan couplers, for example, are particularly emphasized in this regard, being described in U.S. Pat. Nos. 2,474,293, 2,367,531, 2,895,826, 3,772,002, EP-A-0 028 099, EP-A-0 112 514.

The green-sensitive silver halide emulsion layers contain at least one non-diffusing color coupler for producing the magenta component dye image, normally a color coupler of the 5-pyrazolone or the indazolone type. Other suitable magenta couplers are cyanoacetyl compounds, oxazolones and pyrazoloazoles. Particular emphasis is placed, for example, on the magenta couplers described in U.S. Pat. Nos. 2,600,788, 4,383,027, DE-A 1 547 803, DE-A 1 810 464, DE-A 24 08 665, DE-A 32 26 163.

Finally, the blue-sensitive silver halide emulsion layers contain at least one non-diffusing color coupler for producing the yellow component dye image, generally a color coupler containing an open-chain ketomethylene group. Particular emphasis is placed, for example, on the yellow couplers described in U.S. Pat. Nos. 3,408,194, 3,933,501, DE-A 23 29 587, DE-A 24 56 976.

Color couplers of these types are known in large numbers and are described in a number of patent specifications. They are also described, for example, in the Article by W. Pelz entitled "Farbkuppler" (Color Couplers) in "Mitteilungen aus den Forschungslaboratorien der AGFA, Leverkusen/München", Vol. III (1961), page 111, and in K. Venkataraman "The Chemistry of Synthetic Dyes", Vol. 4, 341 to 387, Academic Press (1971).

The color couplers may be 4-equivalent couplers and also 2-equivalent couplers. It is known that 2-equivalent couplers may be derived from 4-equivalent couplers by the fact that they contain in the coupling position a substituent which is released during the coupling reaction. The 2-equivalent couplers include both those which are substantially colorless and also those which have an intensive color of their own which either disappears during the color coupling reaction or is replaced by the color of the image dye produced (mask couplers). In principle, 2-equivalent couplers also include the known white couplers which give substantially colorless products on reaction with color developer oxidation products. 2-Equivalent couplers also include couplers which contain in the coupling position a releasable group which is released on reaction with color developer oxidation products and which develops a certain desired photographic activity, for example as a development inhibitor or accelerator, either directly or after one or more other groups have been released from the group initially released (cf. for example DE-A 27 03 145, DE-A 28 55 697, DE-A 31 05 026, DE-A 33 19 428). Examples of 2-equivalent couplers such as these are the known DIR couplers and also DAR and FAR couplers.

Suitable DIR couplers are described, for example, in GB-A 953,454, DE-A 1 800 420, DE-A 20 15 867, DE-A 24 14 006, DE-A 28 42 063, DE-A 34 27 235.

Suitable DAR and FAR couplers are described, for example, in DE-A 32 09 110, EP-A 0 089 834, EP-A 0 117 511, EP-A 0 118 087.

Since, in the case of DIR, DAR and FAR couplers, the activity of the group released during the coupling reaction is largely desirable with less importance being attributed to the dye-properties of these couplers, DIR, DAR and FAR couplers which give substantially colorless products during the coupling reaction, as described for example in DE-A 1 547 640, are also suitable.

The releasable group may also be a ballast group so that coupling products which are diffusible or which at least show slight or limited mobility, as described for example in U.S. Pat. No. 4,420,556, are obtained in the reaction with color developer oxidation products.

High molecular weight color couplers are described, for example, in DE-C 1 297 417, DE-A 24 07 569, DE-A 31 48 125, DE-A 32 17 200, DE-A 33 20 079, DE-A 33 24 932, DE-A 33 31 743, DE-A 33 40 376, EP-A 27 284, U.S. Pat. No. 4,080,211. The high molecular weight color couplers are generally prepared by polymerization of ethylenically unsaturated monomeric color couplers. However, they may also be obtained by polyaddition or polycondensation.

In addition to the constituents mentioned, the layers may contain other additives, for example hardeners, antioxidants, dye stabilizers and agents for infuencing the mechanical and electrostatic properties. In order to reduce or avoid the adverse effect of UV light on the dye images produced with the color photographic recording materials according to the invention, the layers may also contain UV-absorbing compounds.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The silver halide present as photosensitive constituent in the photographic material may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal paper while silver chloride bromide emulsions having various chloride contents up to pure silver chloride emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example from 12:1 to 30:1.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photoraphique, Paul Montel, Paris (1967); G. F. Duffin, Photographic Emulsion Chemistry, The Focal Press, London (1966); V. L. Selikman et , Making and Coating Photographic Emulsion, The Focal Press, London (1966)).

The emuslions may be ripened, stabilized and spectrally sensitized in the usual way.

EXAMPLE 1

A color photographic recording material for color negative development was prepared by applying the following layers in the order shown to a transparent layer support of cellulose triacetate. The quantities are all based on 1 square meter. For the silver halide applied, the corresponding quantities of $AgNO_3$ are shown. All the silver halide emulsions were stabilized with 0.5 g 4-hydroxy-6-ethyl-1,3,3a,7-tetraazindene per 100 g $AgNO_3$.

Layer 1 (antihalo layer)
- black colloidal silver sol containing 0.5 g Ag, 0.2 g octyl hydroquinone and 1.5 g gelatine Layer 2 (1st red-sensitized layer)
- red-sensitized silver bromide iodide emulsion of 3.5 g AgNO: (mixture of 80% by weight of an emulsion containing 5 mol-% iodide and having a mean particle diameter of 0.2 μm and 20% by weight of an emulsion containing 7 mol-% iodide and having a mean particle diameter of 0.8 μm), 1.7 g gelatine and 0.7 g coupler mixture C 1, emulsified with 0.7 g tricresyl phosphate Layer 3 (2nd red-sensitized layer)
- red-sensitized silver bromide iodide emulsion of 2.0 g $AgNO_3$ (mixture of 20% by weight of an emulsion containing 7 mol-% iodide, mean particle diameter 0.8 μm and narrow particle size distribution and 80% by weight of an emulsion containing 10 mol-% iodide, mean particle diameter 0.8 μm and wide particle size distribution), 2.0 g gelatine and 0.2 g of the coupler mixture C 1 emulsified with 0.2 g tricresyl phosphate.

Layer 4 (intermediate layer)
- 0.7 g gelatine and 0.009 g 2,5-diisoctyl hydroquinone Layer 5 (1st green-sensitized layer)
- green-sensitized silver bromide iodide emulsion of 2.2 g AgNO: (mixture of 65% by weight of an emulsion containing 5 mol-% iodide and having a mean particle diameter of 0.2 m and 35% by weight of an emulsion containing 7 mol-% iodide and having a mean particle diameter of 0.8 μm), 1.7 g gelatine and 0.5 g coupler M 1 emulsified with 0.5 g tricresyl phosphate Layer 6 (2nd green-sensitized layer)
- green-sensitized silver bromide iodide emulsion of 1.5 $AgNO_3$ (mixture of 70% by weight of an emulsion containing 7 mol-% iodide, mean particle diameter 0.8 μm for a narrow particle size distribution and 30% by weight of an emulsion containing 10 mol-% iodide, mean particle diameter 0.8 μm for a wide particle size distribution), 1.7 g gelatine and 0.2 g coupler M 1 emulsified with 0.2 g tricresyl phosphate Layer 7 (intermediate layer)
- 0.5 g gelatine and
- 0.06 g 2,5-diisooctyl hydroquinone Layer 8 (yellow filter layer)
- yellow colloidal silver sol containing
- 0.1 g Ag
- 0.35 g gelatine and
- 0.2 g compound WM-1

Layer 9 (1st blue-sensitive layer)
- silver bromide iodide emulsion of 0.6 g $AgNO_3$ (mixture of 90% by weight of an emulsion containing 5 mol-% iodide, mean particle diameter 0.2 μm, and 10% by weight of an emulsion containing 7 mol-% iodide, mean particle diameter 0.8 μm), 1.4 g gelatine and 0.85 g coupler Y 1 emulsified with 0.85 g tricresyl phosphate Layer 10 (2nd blue-sensitive layer)
- silver bromide iodide emulsion of 1.0 g $AgNO_3$ (mixture of 50% by weight of an emulsion containing 7 mol-% iodide, mean particle diameter 0.8 μm for a narrow particle size distribution, and 50% by weight of an emulsion containing 10 mol-% iodide, mean particle diameter 0.8 μm for a wide particle size distribution), 0.6 g gelatine and 0.3 g coupler Y 1 emulsified with 0.3 g tricresyl phosphate Layer 11 (UV absorber layer)
- 1.5 g gelatine and
- 0.8 g compound UV-1

Layer 12 (intermediate layer)
- 0.9 g gelatine
- 0.45 g compound WM-1

Layer 13
- material 1 according to the invention
  - 0.36 g gelatine
  - 0.05 g alkali-soluble spacer, mean diameter 2 μm, of hydroxypropyl methyl cellulose hexahydrophthalate
  - 0.1 g polymer H 0.032 g dimethyl polysiloxane dispersed in gelatine, mean diameter 0.1 μm
0.015 g compound II
0.1 g $SiO_2$ fine quartz crystals in coated form QD 8, mean diameter 1.0 μm
0.05 g compound I-1
0.75 g instant hardener H-15 material 2 according to the invention
composition as 1, but containing 0.15 g quartz dispersion QD 8 material 3 according to the invention
composition as 1, but containing 0.2 g quartz dispersion QD 8 material 4 according to the invention
composition as 1, but containing 0.25 g quartz dispersion QD 8 material 5 comparison
composition as 1, but without the quartz dispersion QD 8 material 6 comparison
composition as 1, but containing 0.1 g quartz dispersion having a mean diameter of 3 μm instead of the fine quartz crystals material 7 comparison
composition as 1, but containing 0.1 g of a quartz dispersion having a mean diameter of 5 μm instead of the fine quartz crystals material 8 comparison
composition as 3, but without polymer H material 9 comparison
composition as 3, but containing 0.1 g colloidal $SiO_2$ having a mean diameter of 0.3 μm instead of the fine quartz crystals material 10 invention
composition as 9, but containing 0.4 g colloidal $SiO_2$ material 11 comparison
0.35 g gelatine
0.2 g $SrSO_4$ instead of $SiO_2$, mean dimeter 2 μm
0.75 g instant hardener H 15 material 12 comparison
composition as 11, but containing 0.5 g $SrSO_4$

After drying, the wet scratch resistance, parallel break resistance, friction coefficient, torque, and dry scratchability of the unprocessed samples were measured.

Granularity and sharpness and also pencil acceptance and the scratch test were carried out on processed samples.

Wet scratch resistance

The photographic recording materials are placed with the emulsion side upwards on a horizontal sample holder in a tank filled with water of 10° Gh at 38° C. The sample to be measured is completely covered with water. After a swelling time of 5 minutes, a firmly locked steel ball (3.2 mm in diameter) is moved over the surface of the test specimen at a speed v of 30 mm/sec. The force (in N), with which the steel ball mentioned above presses onto the outermost protective layer of the sample, is adjusted in such a way that it increases continuously from 0 to 10N over a distance of 20 cm. The force at which the first sign of layer damage over the measuring zone can be noticed with the human eye after drying of the sample is a measure of the wet scratch resistance of the photographic recording material (in N). The value shown is the mean value from 9 measurements.

The parallel break resistance was characterized by the parameters break diameter (mm) and break force (N). For this test, a 35 mm wide strip of the material perforated along a transverse line was made into a loop and pressed between two parallel jaws steadily approaching one another. The break diameter is the internal diameter of the loop and the break force is the force under which the two jaws act on the loop at the moment when the loop breaks along the perforated line. Mean value from 15 measurements. Method described in Research Disclosure 25 302, 5/85.

The friction coefficient (friction coefficient = tensile force/normal force × 100) is a measure of the adhesive friction when the material begins to slide with its coated side over a surface of $V_2A$ steel ($V_2A/S$) and over the back of the same material (R/S) under the effect of a tensile force; measured at 35° C., 95% relative humidity.

The rewinding torque (Ncm) during forward and return transport is determined as follows on ready-made microfilms:

The films accommodated in the cartridge without the container were acclimatized for 7 days to the test climate (35° C./90% relative air humidity), subsequently loaded into a Leitz Orthomat cassette and further transported at intervals of one frame per second. Immediately after forward transport, the film was rewound in 7 seconds. The particular contributions made by the friction of the cassette mechanism were subtracted from the above values.

The maximum torque occurring and the mean value from 36 transports are shown as a measure of the forward transport. The torque from the beginning of transport and the maximum torque occurring at the end of the transport are shown for the return transport.

The dry scratchability is measured with a Heidon instrument in accordance with JIS Standard 6178 (Stylus Saphire Radius 0.050 mm, angle 90°). The saphire stylus is moved over the dry layer under an increasing weight. The samples had been conditioned for 24 h at 23° C./50% relative humidity before the measurment. The scratch resistance is expressed as the force (mN) at which the stylus leaves a microscopically visible score behind on the layer. Mean value of 20 scratch marks.

Granularity: RMS granularity as described in SPSE Handbook of Photographic Science and Engineering, 1973, page 935, diaphragm 48 μm.

Sharpness: MTF described in SPSE Handbook of Photographic Science and Engineering, 1973, page 946.

Pencil acceptance: after processing, pencil acceptance was tested by retouching and writing tests with pencils having hardnesses of HB, H, 2H, 3H, 4H and 5H. If a material can be written on without damage with a pencil having a hardness of 5H, it is very good (mark 1 = very good; mark 6 = poor).

Scratch test: the unprocessed and processed samples were moved layer-against-layer and layer-against-backing over a distance of 100 mm under a weight of 10N. The scratch marks left on the stationary sample after the treatment are visually evaluated (mark 1 = very good; mark 6 = poor).

The results are shown in the following Tables.

TABLE 1

| Material | Wet scratch resistance (N) | Parallel break resistance: break diameter (mm) | Parallel break resistance: break force (N) | Friction coefficient $V_2A/S$ | Friction coefficient R/S | DSR (mN) | Remarks |
|---|---|---|---|---|---|---|---|
| 1 | 6.5 | 2.8 | 8 | 180 | 190 | 65 | Invention |
| 2 | 6.6 | 2.8 | 8 | 185 | 190 | 65 | " |
| 3 | 6.5 | 2.8 | 8 | 180 | 190 | 68 | " |
| 4 | 6.6 | 2.8 | 8 | 185 | 195 | 65 | " |
| 5 | 6.5 | 2.8 | 8 | 180 | 190 | 65 | Comparison |
| 6 | 5.8 | 3.2 | 7 | 200 | 210 | 52 | " |
| 7 | 5.4 | 3.4 | 7 | 220 | 240 | 45 | " |
| 8 | 5.4 | 2.8 | 8 | 180 | 190 | 62 | " |
| 9 | 5.4 | 3.1 | 7 | 185 | 190 | 45 | " |
| 10 | 5.1 | 3.5 | 6 | 185 | 195 | 48 | " |
| 11 | 5.5 | 3.1 | 7 | 250 | 330 | 47 | " |
| 12 | 5.6 | 3.3 | 7 | 240 | 330 | 49 | " |

TABLE 2

| Material | Torque (Ncm) forward transport max | Torque (Ncm) forward transport $\bar{x}$ | Torque (Ncm) return transport A | Torque (Ncm) return transport E | Granularity RMS visual filter diaphragm 48 μm D = 0.6 | 0.8 | 1.0 | 1.2 | Remarks |
|---|---|---|---|---|---|---|---|---|---|
| 1 | 2.5 | 1.5 | 1.8 | 3.8 | 12.2 | 10.4 | 8.8 | 7.7 | Invention |
| 2 | 2.3 | 1.6 | 1.7 | 3.7 | 12.0 | 9.6 | 8.7 | 7.7 | " |
| 3 | 2.4 | 1.5 | 1.6 | 3.8 | 12.1 | 10.0 | 8.8 | 7.7 | " |
| 4 | 2.5 | 1.5 | 1.8 | 3.7 | 12.3 | 10.3 | 8.8 | 7.7 | " |
| 5 | 2.4 | 1.6 | 1.8 | 4.0 | 11.8 | 9.8 | 9.0 | 7.8 | Comparison |
| 6 | 2.6 | 1.6 | 2.0 | 4.8 | 12.5 | 10.9 | 9.2 | 8.5 | " |
| 7 | 2.8 | 1.8 | 2.0 | 4.6 | 12.6 | 11.2 | 9.3 | 8.8 | " |
| 8 | 2.6 | 1.6 | 1.8 | 3.9 | 12.7 | 10.7 | 9.3 | 8.4 | " |
| 9 | 2.4 | 1.5 | 1.6 | 3.8 | 12.2 | 9.9 | 8.7 | 7.8 | " |
| 10 | 2.3 | 1.6 | 1.7 | 4.0 | 12.2 | 10.3 | 9.0 | 8.1 | " |
| 11 | 3.5 | 3.0 | 2.5 | 6.2 | 13.0 | 11.8 | 9.6 | 9.1 | " |
| 12 | 3.6 | 3.2 | 2.6 | 6.0 | 13.1 | 11.7 | 9.5 | 9.2 | " |

TABLE 3

| material | Sharpness MTF visual filter 5 | 10 | 20 1/mm | Pencil acceptance hardness of pencil | mark | Scratch mark layer/layer | layer/backing | Remarks |
|---|---|---|---|---|---|---|---|---|
| 1 | 1.05 | 0.95 | 0.75 | 3H | 2-3 | 1-2 | 1-2 | Invention |
| 2 | 1.05 | 0.96 | 0.75 | 3H-4H | 2 | 1-2 | 1-2 | " |
| 3 | 1.06 | 0.95 | 0.76 | 4H-5H | 1-2 | 1-2 | 1-2 | " |
| 4 | 1.04 | 0.95 | 0.74 | 5H | 1 | 1-2 | 1-2 | " |
| 5 | 1.05 | 0.96 | 0.75 | HB | 6 | 1 | 1 | Comparison |
| 6 | 1.00 | 0.90 | 0.70 | 5H | 1 | 5 | 5-6 | " |
| 7 | 0.96 | 0.87 | 0.67 | 5H | 1 | 6 | 6 | " |
| 8 | 1.05 | 0.96 | 0.75 | 4H | 1-2 | 1-2 | 1-2 | " |
| 9 | 1.03 | 0.94 | 0.74 | H | 5 | 1-2 | 1-2 | " |
| 10 | 1.03 | 0.93 | 0.74 | H | 5 | 1-2 | 1-2 | " |
| 11 | 1.00 | 0.92 | 0.72 | H-2H | 4 | 2 | 2 | " |
| 12 | 0.98 | 0.90 | 0.70 | 2H | 3 | 2 | 2 | " |

The following compounds were used:

WM-1 Commercially available aqueous dispersion of an anionic, modified polyurethane

UV-1

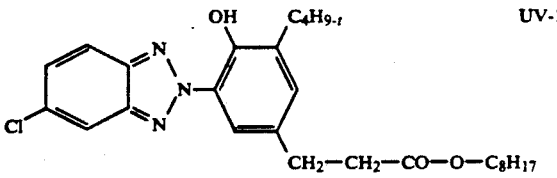

I-1

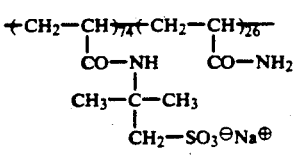

II Copolymer of
98% by weight methyl methacrylate
2% by weight stearyl methacrylate
in the form of beads having a mean diameter of 3 μm C-1 5% by weight

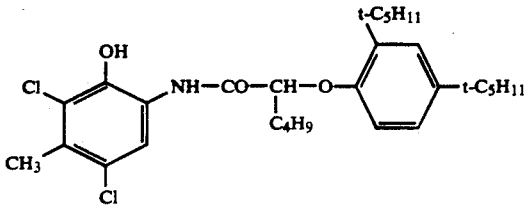

95% by weight

-continued

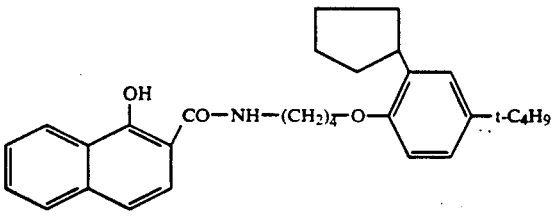

M-1

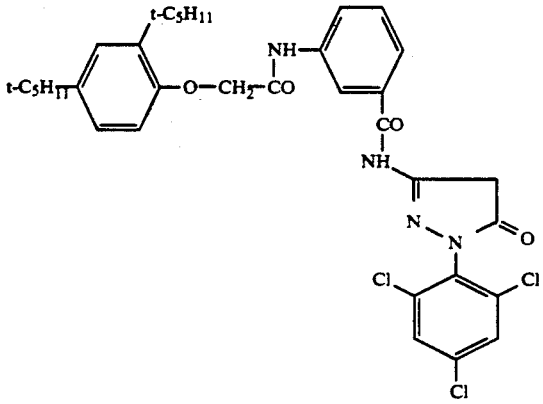

Y-1

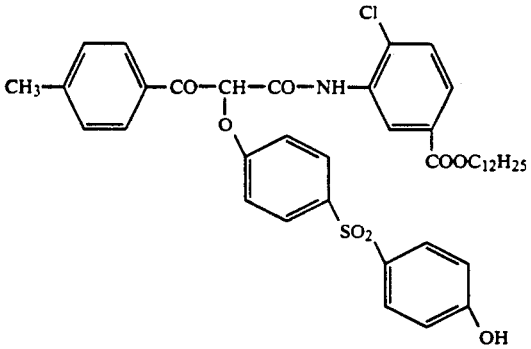

It can be seen from Tables 1 to 3 that materials 1 to 4 according to the invention show good retouchability, high wet scratch resistance and other favorable mechanical properties coupled with low susceptibility to scratching without granularity or sharpness being adversely affected.

Without the fine quartz dispersion according to the invention (material 5), retouchability is poor.

Wet scratch resistance is distinctly less favorable in the absence of a polymer according to the invention (material 8)

We claim:

1. A photographic silver halide element comprising a support, at least one photosensitive silver halide emulsion layer and a protective layer on that side of the at least one silver halide emulsion layer remote from the support, the protective layer containing in combination (a) in a quantity of from 50 to 250 mg/m$^2$ of said protective layer of a polymeric compound (I) containing at least 0.2 mol-% recurring units corresponding to the following formula

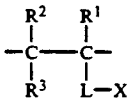

(I)

in which $R^1$, $R^2$ and $R^3$ may be the same or different and represent hydrogen, alkyl or halogen, L is a chemical bond or a standard binding link and X is a reactive group capable of reacting to provide chemical linkage in the protective layer and selected from the group consisting of halogen, epoxy, imido, —NCO, —CH=CH$_2$, —C(CH$_3$)=CH$_2$ or —CN and (b) in quantity of from 50 to 500 mg/m$^2$ of said protective layer of a finely divided crystalline $SiO_2$-dispersion having a particle size distribution in which less than 0.2% by volume of the Si:O$_2$ particles are larger than 4 μm and having an average particle diameter (number average) of from 0.7 to 1.2 μm.

2. A photographic silver halide element as claimed in claim 1 containing additionally a backing layer containing the combination of (a) and (b) as defined in claim 1.

3. A photographic silver halide element as claimed in claim 1 in which the protective layer or backing layer additionally contains a binder and the ratio by weight of binder to polymer to $SiO_2$ is 1:0.2 to 5:0.3 to 2.0.

4. A photographic silver halide element as claimed in claim 1, in which the polymer I contains recurring units having the following structure

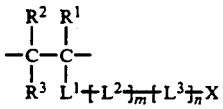

in which $R^1$, $R^2$, $R^3$ and X are as defined in claim 1 and $L^1$ is a —CONH—, —COO— or phenylene group, $L^2$ is an alkylene group containing 1 to 20 C atoms or an arylene group containing 6 to 20 C atoms, $L^3$ is a —COO—, —OCO—, —CONH—, —NH—CO—O—, —NHCO—, —SO$_2$NH—, —NHSO$_2$—, —SO$_2$— group or —O—, m=0, 1 or 2 and n=0, 1 or 2.

5. A photographic silver halide element as claimed in claim 1, of which the layers are hardened with an instant hardener, and instant hardener being understood to be a compound which crosslinks a suitable binder in such a way that, immediately after casting but at the latest 24 hours after casting, hardening has advanced to such a extent that there is no further change in the sensitometry and swelling of the layer combination as a result of the crosslinking reaction.

6. A photographic silver halide element as claimed in claim 5, in which the instant hardener corresponds to the following formula

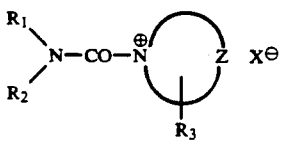

(a)

in which $R_1$ is alkyl, aryl or aralkyl, $R_2$ has the same meaning as $R_1$ or represents alkylene, arylene, aralkylene or alkaralkylene, the second bond being attached to a group corresponding to formula

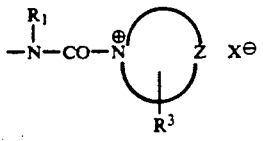

or $R_1$ and $R_2$ together represent the atoms required to complete an optionally substituted heterocyclic ring, for example a piperidine, piperazine or morpholine ring, the ring optionally being substituted, for example, by $C_{1-3}$ alkyl or halogen, $R_3$ is hydrogen, alkyl, aryl, alkoxy, $—NR_4—COR_5—$, $—(CH_2)_M—NR_8R_9$; $—(CH_2)_n—CONR_{13}R_{14}—$ or $$—(CH_2)_p—\underset{\underset{R_{15}}{|}}{CH}—Y—R_{16}$$

or is a bridge member or a direct bond to a polymer chain, $R_4$, $R_6$, $R_7$, $R_9$, $R_{14}$, $R_{15}$, $R_{17}R_{18}$ and $R_{19}$ being hydrogen or $C_1$–$C_4$ alkyl, $R_5$ being hydrogen, $C_{1-4}$ alkyl or $NR_6R_7$, $R_5$ being $—COR_{10}$, $R_{10}$ being $NR_{11}R_{12}$, $R_{11}$ being $C_{1-4}$ alkyl or aryl, particularly phenyl, $R_{12}$ being hydrogen, $C_{1-4}$ alkyl or aryl, particularly phenyl, $R_{13}$ being hydrogen, $C_{1-4}$ alkyl or aryl, particularly phenyl, $R_{16}$ being hydrogen, $C_{1-4}$ alkyl, $COR_{18}$ or $CONHR_{19}$, m being a number of 1 to 3, n being a number of 0 to 3, p being a number of 2 to 3 and Y being O or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

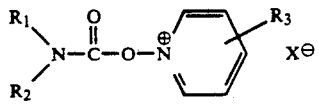

(b)

in which $R_1$, $R_2$, $R_3$ and $X^{\ominus}$ are as defined for formula (a).

* * * * *